US010551040B2

(12) United States Patent
Shah et al.

(10) Patent No.: US 10,551,040 B2
(45) Date of Patent: Feb. 4, 2020

(54) LIGHTING TRIM RING FRICTION FIT SYSTEM

(71) Applicant: EV Research, LLC, Atlanta, GA (US)

(72) Inventors: Ashok Deepak Shah, Atlanta, GA (US); Frederic Perry Phillips, Suzhou (CN)

(73) Assignee: EPISTAR CORPORATION, Hsinchu (TW)

( * ) Notice: Subject to any disclaimer, the term of this patent is extended or adjusted under 35 U.S.C. 154(b) by 92 days.

(21) Appl. No.: 15/722,361

(22) Filed: Oct. 2, 2017

(65) Prior Publication Data

US 2019/0101266 A1 Apr. 4, 2019

(51) Int. Cl.

| | |
|---|---|
| ***F21V 17/16*** | (2006.01) |
| ***F21S 8/02*** | (2006.01) |
| ***F21V 17/18*** | (2006.01) |

(52) U.S. Cl.

CPC ..... *F21V 17/16* (2013.01); *F21S 8/02* (2013.01); *F21S 8/026* (2013.01); *F21V 17/164* (2013.01); *F21V 17/18* (2013.01)

(58) Field of Classification Search

CPC ... F21V 17/18; F21V 17/16; F21S 8/02; F21S 8/026

USPC ..... 362/374, 364

See application file for complete search history.

(56) References Cited

U.S. PATENT DOCUMENTS 4,293,895 A * 10/1981 Kristofek ..... F21V 21/04 248/27.1
4,475,147 A * 10/1984 Kristofek ..... F21S 8/026 362/147
5,377,087 A * 12/1994 Yoon ..... F21V 21/30 362/148
5,707,143 A * 1/1998 Hentz ..... F21S 8/02 362/147
6,361,193 B1 * 3/2002 Gabrius ..... F21S 8/02 362/147
8,182,119 B2 * 5/2012 Trott ..... F21S 8/026 362/365
8,845,145 B1 * 9/2014 Tam ..... F21S 8/026 362/364
9,039,254 B2 * 5/2015 Danesh ..... F21V 21/30 362/364
2006/0091272 A1 * 5/2006 Piel ..... F16B 13/0808 248/231.9
2017/0307143 A1 10/2017 Shah
2017/0307198 A1 10/2017 Shah
2017/0311399 A1 10/2017 Shah

* cited by examiner

*Primary Examiner* — William N Harris

(74) *Attorney, Agent, or Firm* — Patterson + Sheridan, LLP

(57) ABSTRACT

A trim system includes a trim housing defining a top trim housing end and a bottom trim housing end, the trim housing defining an inner trim housing surface, the inner trim housing surface defining a trim housing bore extending into the trim housing from the bottom trim housing end towards the top trim housing end, the trim housing bore defining an axis; and a trim piece defining a top trim piece end and a bottom trim piece end, the top trim piece end inserted into the trim housing bore, the trim piece including a retention clip defining a first end and a second end, the first end secured to a base of the trim piece, the second end defining at least one tooth, the at least one tooth cutting into the inner trim housing surface and axially securing the trim piece to the trim housing relative to the axis.

6 Claims, 11 Drawing Sheets

LIGHTING TRIM RING FRICTION FIT SYSTEM

TECHNICAL FIELD

This disclosure relates to trim system. More specifically, this disclosure relates to trim system for a can light assembly.

BACKGROUND

Many existing recessed light fixtures, such as can light fixtures, include a separate trim piece which attaches to a trim housing of the can light fixture with springs, such as coil spring or torsion springs. The springs must be connected to brackets, hooks, or apertures disposed within a trim housing bore of the trim housing in order to secure the trim piece to the trim housing. Because recessed light fixtures are often in difficult to access locations, such as a ceiling, it can be difficult to safely access the trim housing bore in order to attach the springs, and attaching the springs generally requires the use of both hands. Typically an installer will be standing upon a ladder to install the trim piece and because the operation requires the use of both hands, the installer cannot hold onto the ladder for safety. Additionally, installers with large hands can find it difficult to access the trim housing bore, particularly on smaller lights such as 4" diameter can light fixtures.

Once the trim piece is installed in the trim housing, the trim piece can be difficult to adjust. For example, the trim piece can hang too low relative to the trim housing which can provide an unsightly gap between the trim piece and the ceiling. Often times, the trim piece can sag, such as when the trim piece is loosened by vibrations from footsteps on the floor above. The trim piece can be difficult to adjust and remove because the trim piece blocks access to the trim housing bore when installed, thereby making it difficult to detach the springs to release the trim piece from the trim housing.

SUMMARY

It is to be understood that this summary is not an extensive overview of the disclosure. This summary is exemplary and not restrictive, and it is intended to neither identify key or critical elements of the disclosure nor delineate the scope thereof. The sole purpose of this summary is to explain and exemplify certain concepts of the disclosure as an introduction to the following complete and extensive detailed description.

Disclosed is a trim system comprising a trim housing defining a top trim housing end and a bottom trim housing end, the trim housing defining an inner trim housing surface, the inner trim housing surface defining a trim housing bore extending into the trim housing from the bottom trim housing end towards the top trim housing end, the trim housing bore defining an axis; and a trim piece defining a top trim piece end and a bottom trim piece end, the top trim piece end inserted into the trim housing bore, the trim piece comprising a retention clip defining a first end and a second end, the first end secured to a base of the trim piece, the second end defining at least one tooth, the at least one tooth cutting into the inner trim housing surface and axially securing the trim piece to the trim housing relative to the axis.

Also disclosed is a trim system comprising a trim housing defining a top trim housing end and a bottom trim housing end, the trim housing defining an inner trim housing surface, the inner trim housing surface defining a trim housing bore extending into the trim housing from the bottom trim housing end towards the top trim housing end, the trim housing bore defining an axis, the inner trim housing surface defining a plurality of grooves; and a trim piece defining a top trim piece end and a bottom trim piece end, the top trim piece end inserted into the trim housing bore, the trim housing bore defines an axis, the trim piece comprising a retention clip defining a first end and a second end, the first end secured to a base of the trim piece, the second end engaging a groove of the plurality of grooves and axially securing the trim piece to the trim housing relative to the axis.

Also disclosed is a method for securing a trim piece to a trim housing, the method comprising inserting a top trim piece end of the trim piece into a trim housing bore of the trim housing, the trim housing bore defined by an inner trim housing surface of the trim housing; and engaging a retention clip with the inner trim housing surface, the retention clip attached to the trim housing, the trim piece secured to the trim housing by engagement between the retention clip and the inner trim housing surface.

Various implementations described in the present disclosure may include additional systems, methods, features, and advantages, which may not necessarily be expressly disclosed herein but will be apparent to one of ordinary skill in the art upon examination of the following detailed description and accompanying drawings. It is intended that all such systems, methods, features, and advantages be included within the present disclosure and protected by the accompanying claims. The features and advantages of such implementations may be realized and obtained by means of the systems, methods, features particularly pointed out in the appended claims. These and other features will become more fully apparent from the following description and appended claims, or may be learned by the practice of such exemplary implementations as set forth hereinafter.

BRIEF DESCRIPTION OF THE DRAWINGS

The features and components of the following figures are illustrated to emphasize the general principles of the present disclosure. The drawings are not necessarily drawn to scale. Corresponding features and components throughout the figures may be designated by matching reference characters for the sake of consistency and clarity.

DETAILED DESCRIPTION

Figure 1:
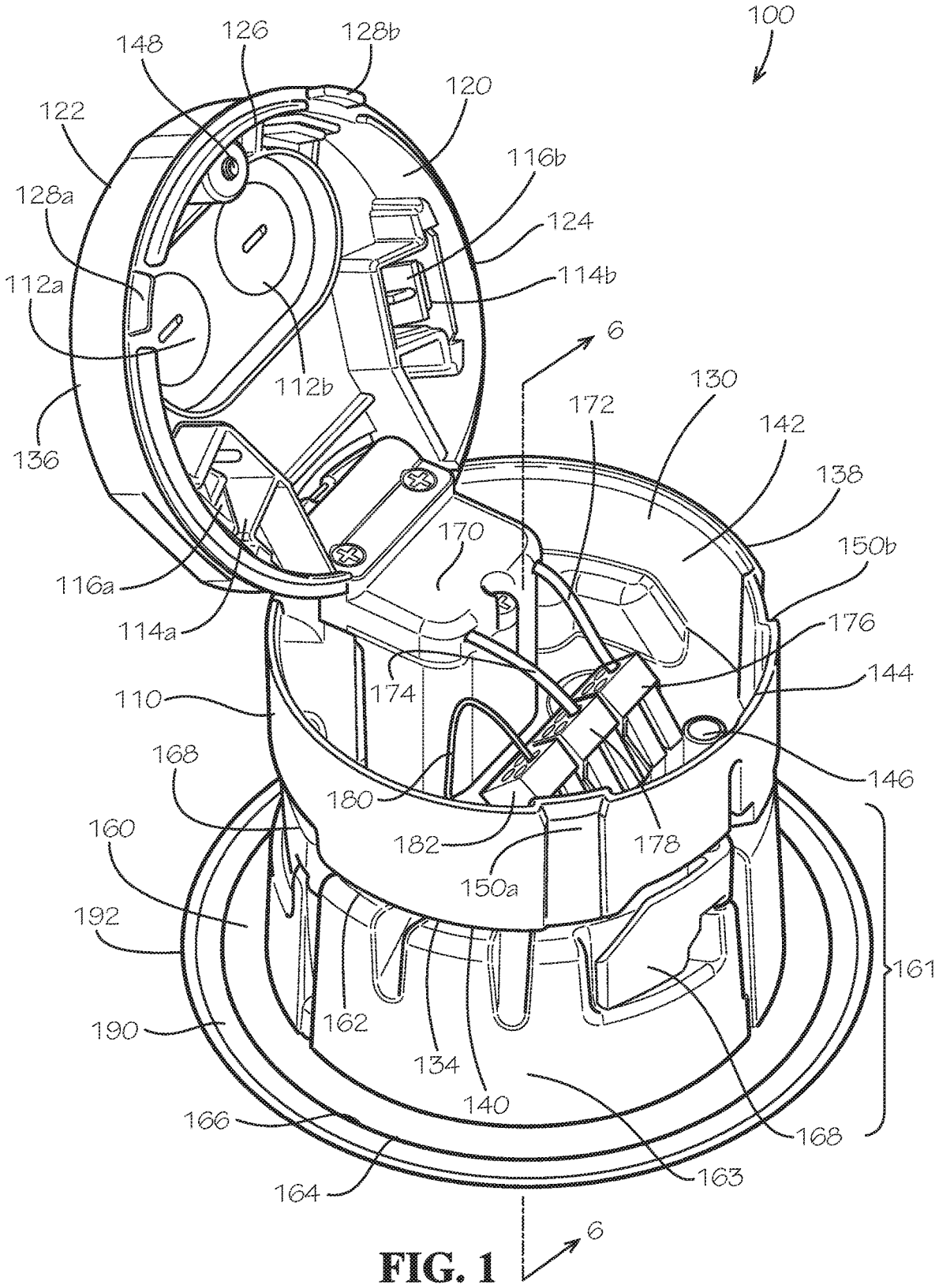
FIG. 1 is a perspective view of a can light assembly with a lid of the can light assembly in an open position in accordance with one aspect of the present disclosure.

The present disclosure can be understood more readily by reference to the following detailed description, examples, drawings, and claims, and the previous and following description. It is to be understood that this disclosure is not limited to the specific devices, systems, and/or methods disclosed unless otherwise specified, and, as such, can, of course, vary. It is also to be understood that the terminology used herein is for the purpose of describing particular aspects only and is not intended to be limiting.

The following description is provided as an enabling teaching of the present devices, systems, and/or methods in its best, currently known aspect. To this end, those skilled in the relevant art will recognize and appreciate that many changes can be made to the various aspects of the present devices, systems, and/or methods described herein, while still obtaining the beneficial results of the present disclosure. It will also be apparent that some of the desired benefits of the present disclosure can be obtained by selecting some of the features of the present disclosure without utilizing other features. Accordingly, those who work in the art will recognize that many modifications and adaptations to the present disclosure are possible and can even be desirable in certain circumstances and are a part of the present disclosure. Thus, the following description is provided as illustrative of the principles of the present disclosure and not in limitation thereof.

As used throughout, the singular forms "a," "an" and "the" include plural referents unless the context clearly dictates otherwise. Thus, for example, reference to "an element" can include two or more such elements unless the context indicates otherwise.

Ranges can be expressed herein as from "about" one particular value, and/or to "about" another particular value. When such a range is expressed, another aspect includes from the one particular value and/or to the other particular value. Similarly, when values are expressed as approximations, by use of the antecedent "about," it will be understood that the particular value forms another aspect. It will be further understood that the endpoints of each of the ranges are significant both in relation to the other endpoint, and independently of the other endpoint.

For purposes of the current disclosure, a material property or dimension measuring about X or substantially X on a particular measurement scale measures within a range between X plus an industry-standard upper tolerance for the specified measurement and X minus an industry-standard lower tolerance for the specified measurement. Because tolerances can vary between different materials, processes and between different models, the tolerance for a particular measurement of a particular component can fall within a range of tolerances.

As used herein, the terms "optional" or "optionally" mean that the subsequently described event or circumstance can or cannot occur, and that the description includes instances where said event or circumstance occurs and instances where it does not.

The word "or" as used herein means any one member of a particular list and also includes any combination of members of that list. Further, one should note that conditional language, such as, among others, "can," "could," "might," or "may," unless specifically stated otherwise, or otherwise understood within the context as used, is generally intended to convey that certain aspects include, while other aspects do not include, certain features, elements and/or steps. Thus, such conditional language is not generally intended to imply that features, elements and/or steps are in any way required for one or more particular aspects or that one or more particular aspects necessarily include logic for deciding, with or without user input or prompting, whether these features, elements and/or steps are included or are to be performed in any particular aspect.

Disclosed are components that can be used to perform the disclosed methods and systems. These and other components are disclosed herein, and it is understood that when combinations, subsets, interactions, groups, etc. of these components are disclosed that while specific reference of each various individual and collective combinations and permutation of these may not be explicitly disclosed, each is specifically contemplated and described herein, for all methods and systems. This applies to all aspects of this application including, but not limited to, steps in disclosed methods. Thus, if there are a variety of additional steps that can be performed it is understood that each of these additional steps can be performed with any specific aspect or combination of aspects of the disclosed methods.

According to some aspects, a can light assembly is discussed along with associated methods, systems, devices, and various apparatus. The can light assembly comprises a junction box, a light engine, a trim piece, and a trim housing. It would be understood by one of skill in the art that the can light assembly is described in but a few exemplary embodiments among many. No particular terminology or description should be considered limiting on the disclosure or the scope of any claims issuing therefrom.

FIG. 1 is a perspective view of a can light assembly 100 in accordance with one aspect of the present disclosure. As shown, a lid 120 of the can light assembly is in an open position. The can light assembly 100 can comprise a junction box 110, a trim housing 160, and a trim piece 190. The trim piece 190 can be received by the trim housing 160, and the trim housing 160 can be attached to the junction box 110. The trim piece 190 and the trim housing 160 can comprise a trim system 161 of the can light assembly 100.

Figure 10:
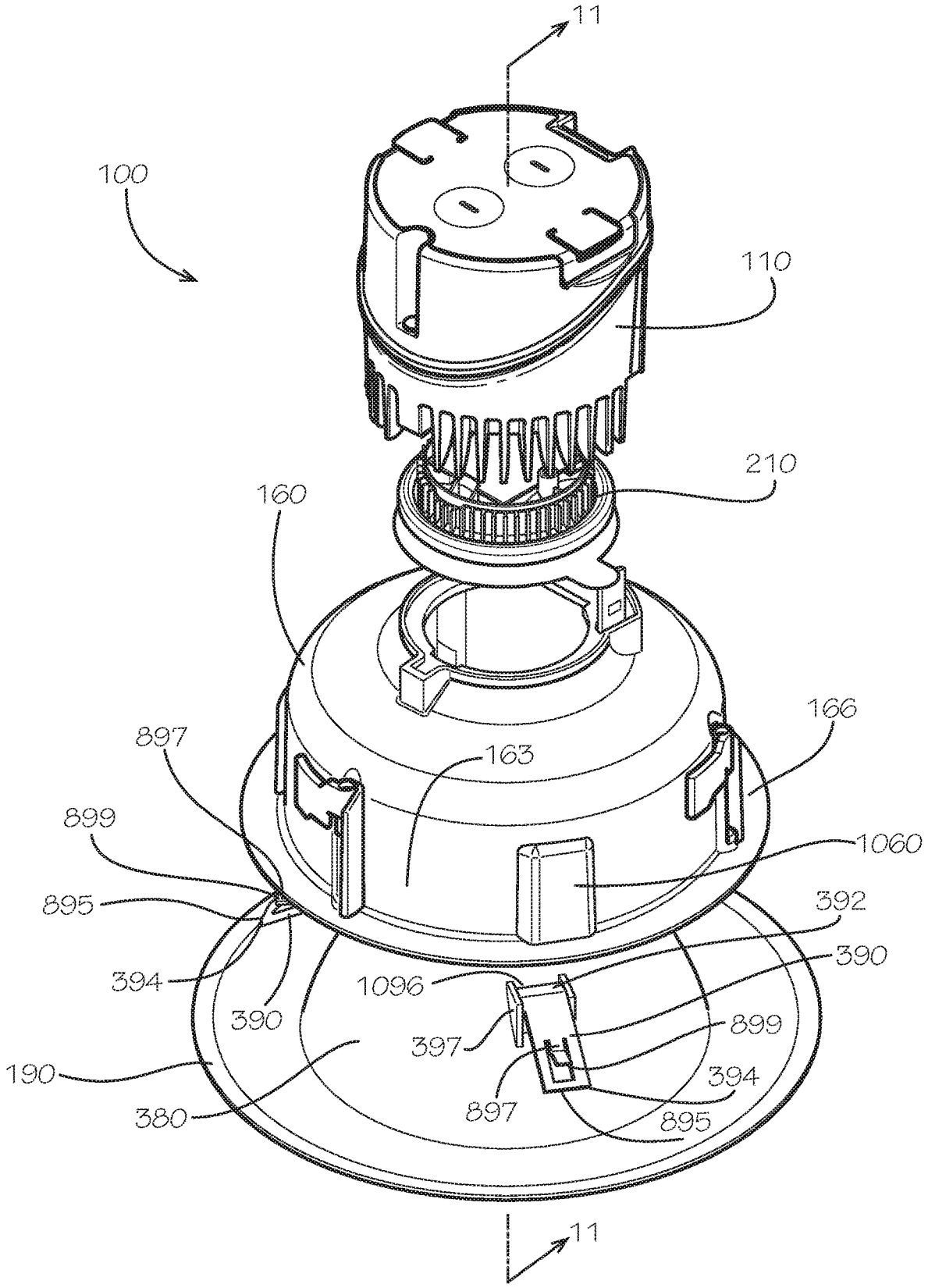
FIG. 10 is a perspective exploded view of another aspect of the can light assembly in accordance with another aspect of the present disclosure.

In the present aspect, the trim housing 160 and the trim piece 190 can be sized to fit within a 4" diameter nominal opening in a ceiling, a tile, or other overheard structure (not shown). In other aspects, the opening can be larger or smaller than the 4" diameter nominal opening, such as a 6" diameter nominal opening as shown in FIG. 10, for example and without limitation. In the present aspect, the trim housing 160 can comprise a plurality of bull clips 168 configured to retain the can light assembly 100 within the opening. The bull clips 168 can be attached to a belled portion 163 of the trim housing 160. The bull clips 168 are shown in a stored position wherein the bull clips 168 rest substantially flush with the belled portion 163 of the trim housing 160, thereby allowing the junction box 110 and the trim housing 160 to be inserted through the opening without interference. Once the trim housing 160 is inserted through the opening, the bull clips 168 can be rotated to a deployed position wherein the bull clips 168 can extend outwards from the trim housing 160, thereby preventing withdrawal of the trim housing 160 and the junction box 110 from the opening.

The junction box 110 can comprise the lid 120 and a junction box housing 130. The junction box 110 can define a top junction box end 136 and a bottom junction box end 134. The top junction box end 136 can be defined by the lid 120, and the bottom junction box end 134 can be defined by the junction box housing 130. In the present aspect, the lid 120 can be hingedly attached to the junction box housing 130, and the lid 120 can be selectively positionable about and between the open position and a closed position shown in FIG. 2.

A junction box housing 130 can define a top junction box housing end 138 and a bottom junction box housing end 140. In the present aspect, the bottom junction box housing end 140 can define the bottom junction box end 134. A junction box cavity 142 can be defined extending into the junction box housing 130 from the top junction box housing end 138 towards the bottom junction box housing end 140, and a cavity opening 144 of the junction box cavity 142 can be defined at the top junction box housing end 138.

With the lid 120 in the open position, the cavity opening 144 can be uncovered, and the junction box cavity 142 can be exposed. When the lid 120 is in the closed position, the lid 120 can cover the cavity opening 144 and enclose the junction box cavity 142. The lid 120 can define a top lid end 122 and a bottom lid end 124. The top lid end 122 can define the top junction box end 136. The bottom lid end 124 can be shaped and sized complimentary to the top junction box housing end 138.

The lid 120 can define an inner lip 126 extending downwards from the bottom lid end 124, and the inner lip 126 can be configured to fit within the cavity opening 144 to align the lid 120 with the junction box housing 130 in the closed position. The lid 120 can also define a pair of clips 128*a,b* extending downwards from the bottom lid end 124, and the clips 128*a,b* can be configured to respectively slip over a pair of notches 150*a,b* defined by the junction box housing 130 to further align the lid 120 with the junction box housing 130. In some aspects, the clips 128*a,b* can be configured to latch with the respective notches 150*a,b* to secure the lid 120 in the closed position. In the present aspect, the lid 120 can comprise a fastener 148 which can engage a threaded hole 146 defined at the top junction box housing end 138 of the junction box housing 130 in order to secure the lid 120 in the closed position.

Figure 6:
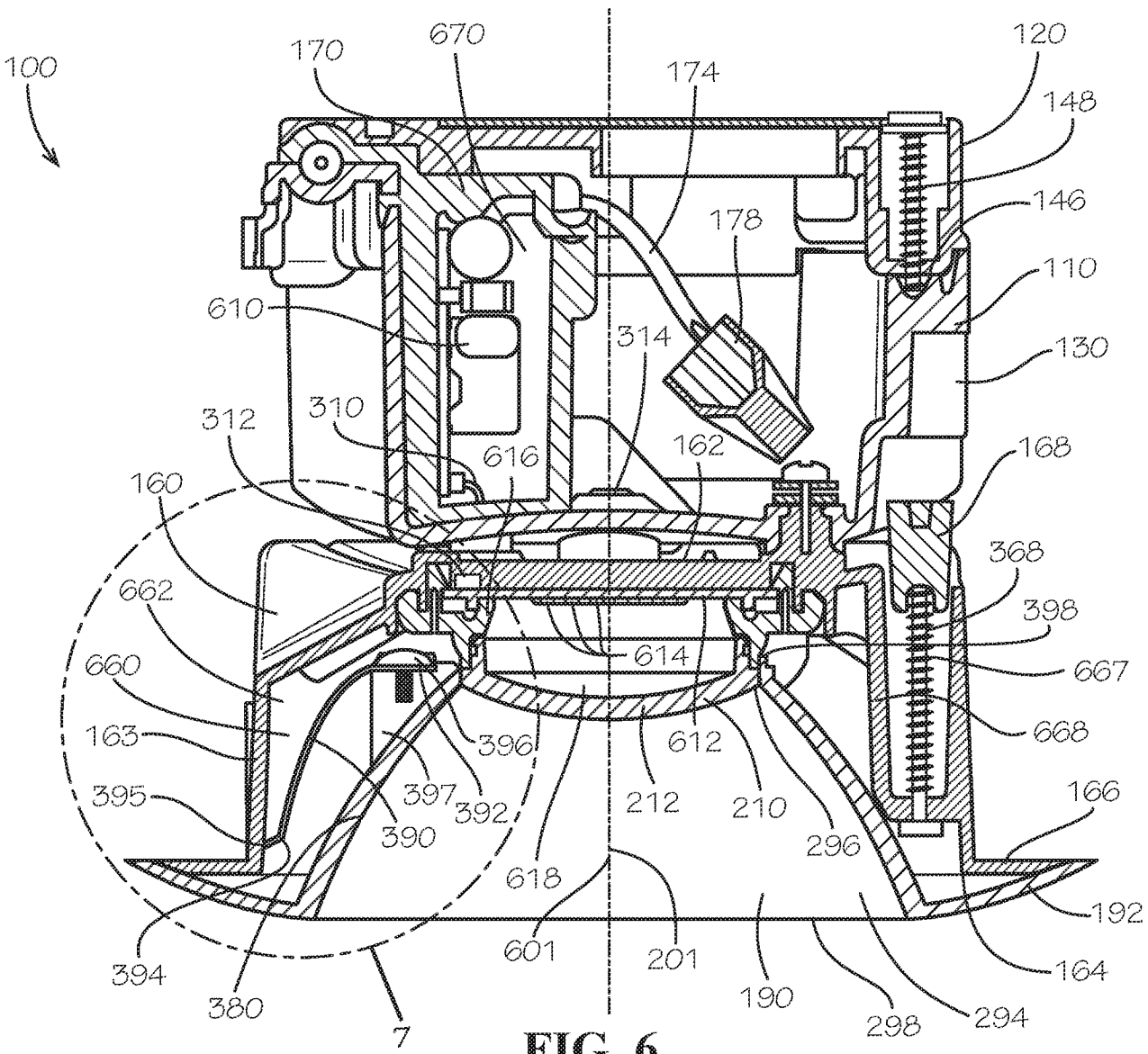
FIG. 6 is cross-sectional view of the can light assembly of FIG. 1 with the lid in the closed position, taken along line 6-6 shown in FIG. 1.

A circuit box 170 can be disposed within the junction box cavity 142, and the circuit box 170 can enclose and protect a circuit board 610, as shown in FIG. 6. A positive lead 172 and a negative lead 174 can extend outwards through the circuit box 170 to provide positive and negative electrical connections to the circuit board 610. In the present aspect, the leads 172,174 can provide an alternating current ("AC") power input to the circuit board 610. Wire connector blocks 176,178 can be respectively attached to the ends of the positive lead 172 and the negative lead 174. In the present aspect, each of the wire connector blocks 176,178 can be a stab-in connector configured to electrically connect to one or more bare wire ends when the bare wire ends are stabbed into the respective wire connector blocks 176,178. A grounding lead 180 can also be attached to the junction box housing 130, and the grounding lead 180 can comprise a wire connector block 182, such as a stab-in connector, to provide an electrical grounding connection for the circuit board 610.

The lid 120 can define a pair of conduit knockouts 112*a,b* which can be positioned at the top lid end 122. The conduit knockouts 112*a,b* can be pre-cut into the top lid end 122. The conduit knockouts 112*a,b* can be removed from the lid 120 with minimal force to allow metallic or non-metallic flexible conduits to be attached to the junction box 110 and the leads 172,174,180 disposed within the junction box cavity 142. In the present aspect, the lid 120 can also define a pair of stress-relieving inlets 114*a,b* which can each respectively define a spring clip 116*a,b* configured to frictionally engage a cable or wire inserted through the respective stress-relieving inlets 114*a,b* to prevent the cable or wire from being pulled out of the stress-relieving inlet 114*a,b* under tension.

The trim housing 160 can define a top trim housing end 162 and a bottom trim housing end 164. The top trim housing end 162 can be attached to the bottom junction box end 134 of the junction box 110. A trim housing rim 166 can be disposed at the bottom trim housing end 164, and the trim housing rim 166 can extend outwards from the belled portion 163 of the trim housing 160. The trim piece 190 can define a trim piece rim 192 which can be positioned against the trim housing rim 166. The trim piece rim 192 can extend outwards beyond the trim housing rim 166 so that the trim housing rim 166 can be concealed when viewed from below, as shown in FIG. 2.

Figure 2:
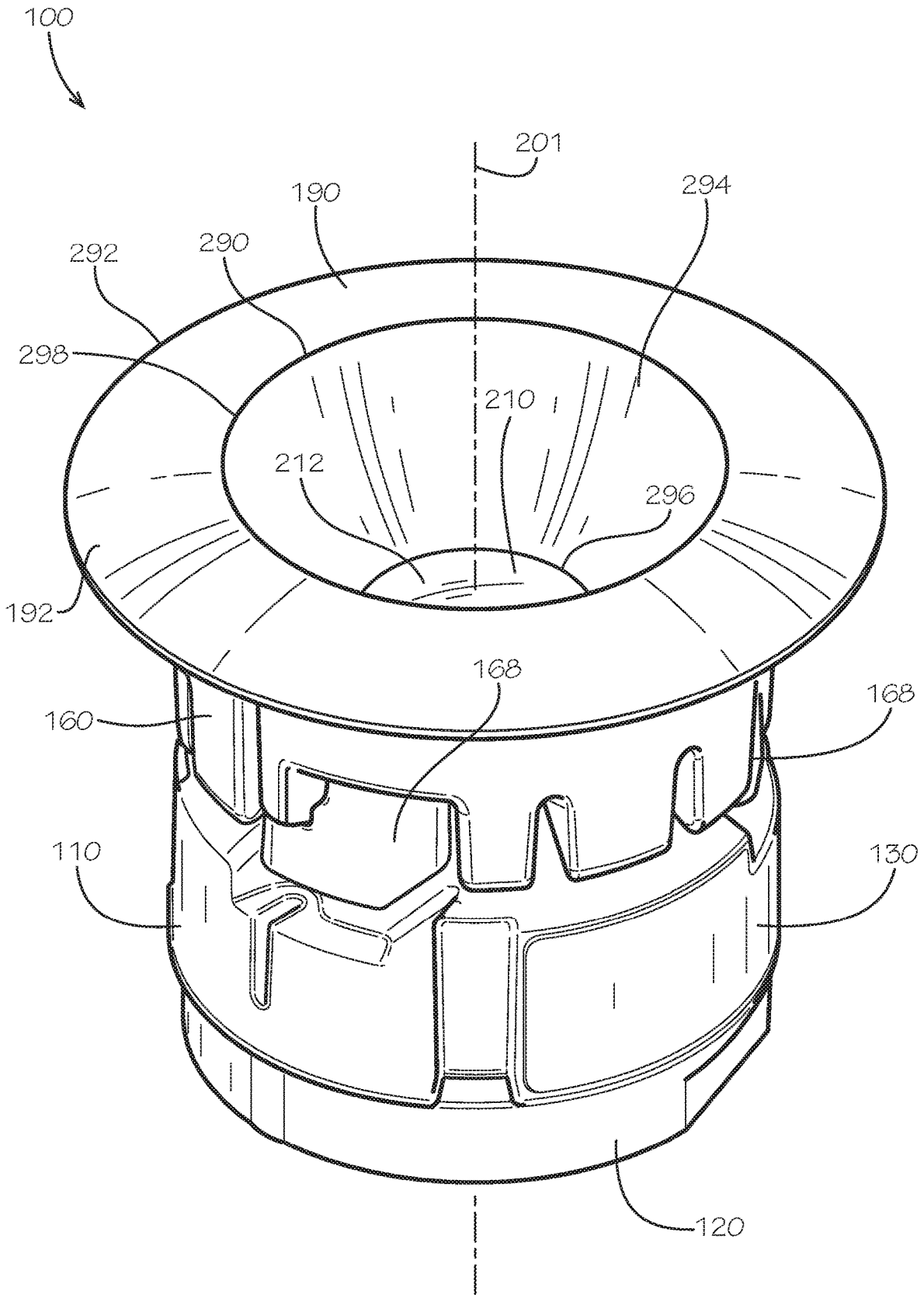
FIG. 2 is an a bottom perspective view of the can light assembly of FIG. 1 with the lid in a closed position.

FIG. 2 is a bottom perspective view of the can light assembly 100 of FIG. 1. The trim piece rim 192 can define an outer trim lip edge 292, and the trim piece 190 can define a bottom trim aperture 290 disposed inward from the outer trim lip edge 292. The bottom trim aperture 290 can define a bottom trim piece end 298 of the trim piece 190. The trim piece 190 can define a trim piece bore 294 extending through the trim piece 190. The trim piece bore 294 can define an axis 201. In the present aspect, the trim piece bore 294 can be a parabolic segment extending between the bottom trim aperture 290 and a top trim aperture 296. In other aspects, the trim piece bore 294 can be frustoconical, a hemispherical segment, or any other suitable shape. In some aspects, a plurality of stepped baffles (not shown) can be defined within the trim piece bore 294. The can light assembly 100 can further comprise a light engine 210, and a lens 212 of the light engine 210 can be positioned within the top trim aperture 296. The light engine 210 can be configured to emit visible light through the lens 212 which can be reflected and directed by the trim piece bore 294. The top trim aperture 296 can be defined at a top trim piece end 398 shown in FIG. 3.

Figure 3:
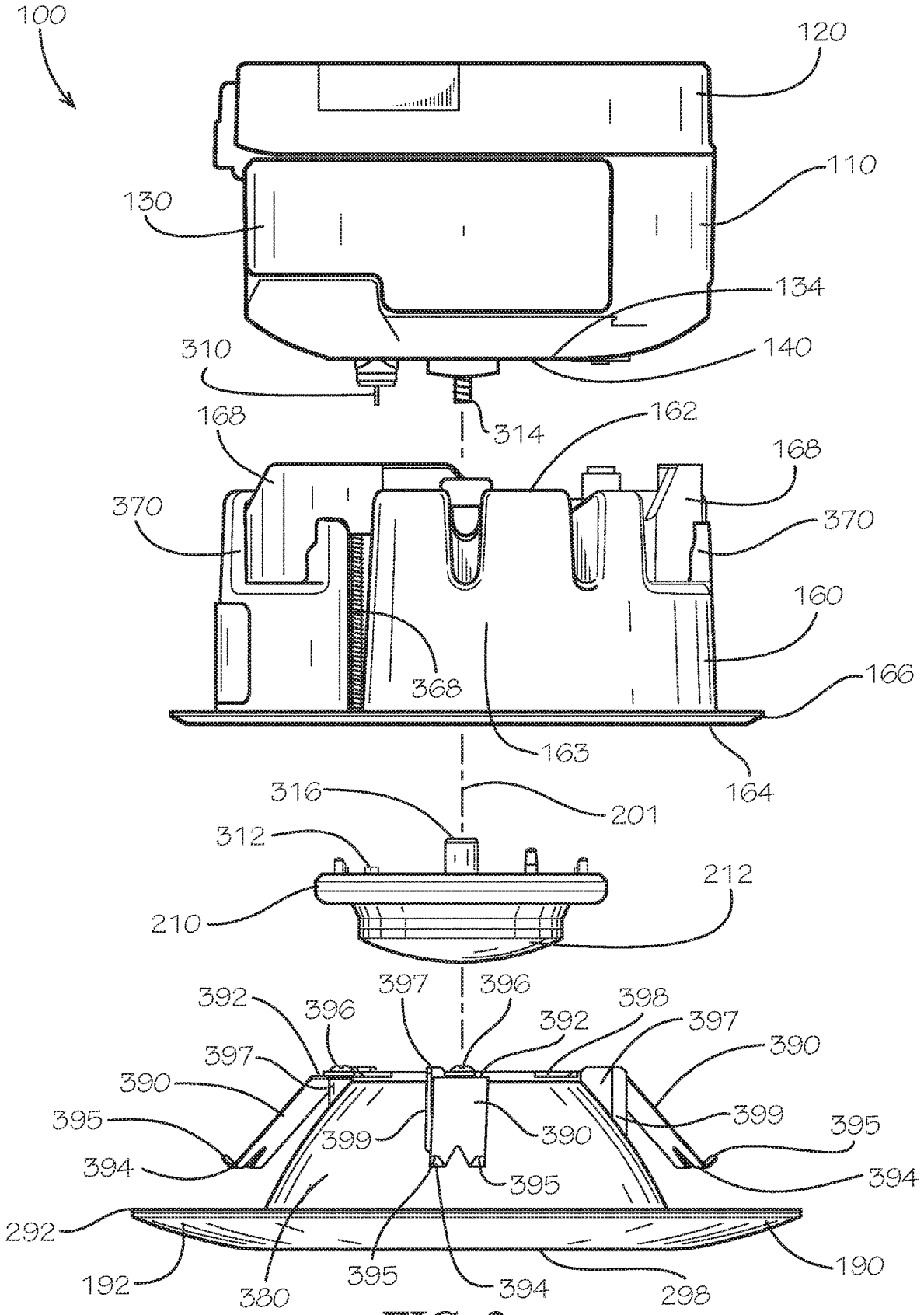
FIG. 3 is an exploded side view of the can light assembly of FIG. 1.

FIG. 3 is an exploded side view of the can light assembly 100 of FIG. 1. As shown, a first pin connector 310 and a fastener 314 can extend downwards from the bottom junction box housing end 140. When assembled, the first pin connector 310 and the fastener 314 can extend through the top trim housing end 162 of the trim housing 160 to respectively engage a second pin connector 312 and a threaded socket 316 of the light engine 210. In the present aspect, the first pin connector 310 can be a male pin connector, and the second pin connector 312 can be a female pin connector. By engaging the pin connectors 310,312, the light engine 210 can be connected in electrical communication with the circuit board 610 (shown in FIG. 6). The fastener 314 can engage the threaded socket 316 to secure the light engine 210 to the trim housing 160 and the junction box 110.

The bull clips 168 of the trim housing 160 can each be mounted on a threaded fastener 368. The threaded fasteners 368 can be configured to rotate the bull clips 168 about and between the stored position shown and the deployed position. The threaded fasteners 368 can also be configured to draw the respective bull clips 168 towards the bottom trim housing end 164 in order to position the trim housing rim 166 against an edge of the opening (not shown) of a ceiling, a tile, or other ceiling material. In the stored position, the bull clips 168 can be positioned in pockets 370 defined by the belled portion 163 of the trim housing 160 such that the bull clips 168 do not extend radially outward from the trim housing 160 with respect to the axis 201.

The trim piece 190 can define a reflector portion 380 extending between the top trim piece end 398 and the bottom trim piece end 298. The trim piece 190 can comprise a plurality of retention clips 390 disposed external to the reflector portion 380. Each retention clip 390 can define a first end 392 and a second end 394 disposed opposite from the first end 392. The first end 392 of each retention clip 390 can be attached to a base 397 by a fastener 396 at the top trim piece end 398 of the trim piece 190. Each retention clip 390 can be configured to rotate about the respective fastener 396, and each base 397 can define a wall 399 sized and positioned to limit a rotational range of the respective retention clip 390. In the present aspect, the retention clips 390 can be in an engaged position wherein each retention clip 390 extends at least partially radially outward from the first end 392 to the second end 394 relative to the axis 201. In the present aspect, the retention clips 390 can each extend radially outward and axially downward from the first end 392 to the second end 394 with respect to the axis 201.

The retention clips 390 can each define one or more teeth 395 disposed at the respective second end 394 of the retention clip 390. In the present aspect, each retention clip 390 can define two teeth 395; however in other aspects, the retention clips 390 can define greater or fewer than two teeth 395. The teeth 395 can be angled relative to the second end 394 of the respective retention clips 390, and the teeth 395 can extend outwards from the second end 394 at least partially in a radially outward direction with respect to the axis 201. With the trim piece 190 removed from the trim housing 160, the teeth 395 can extend radially outward and axially upward from the respective second ends 394 with respect to the axis 201. The teeth 395 can be configured to engage the trim housing 160 to retain the trim piece 190 within the trim housing 160. Engagement between the trim housing 160 and the teeth 395 can deflect the retention clips 390 radially inward as shown and described in further detail with respect to FIG. 7.

Figure 4:
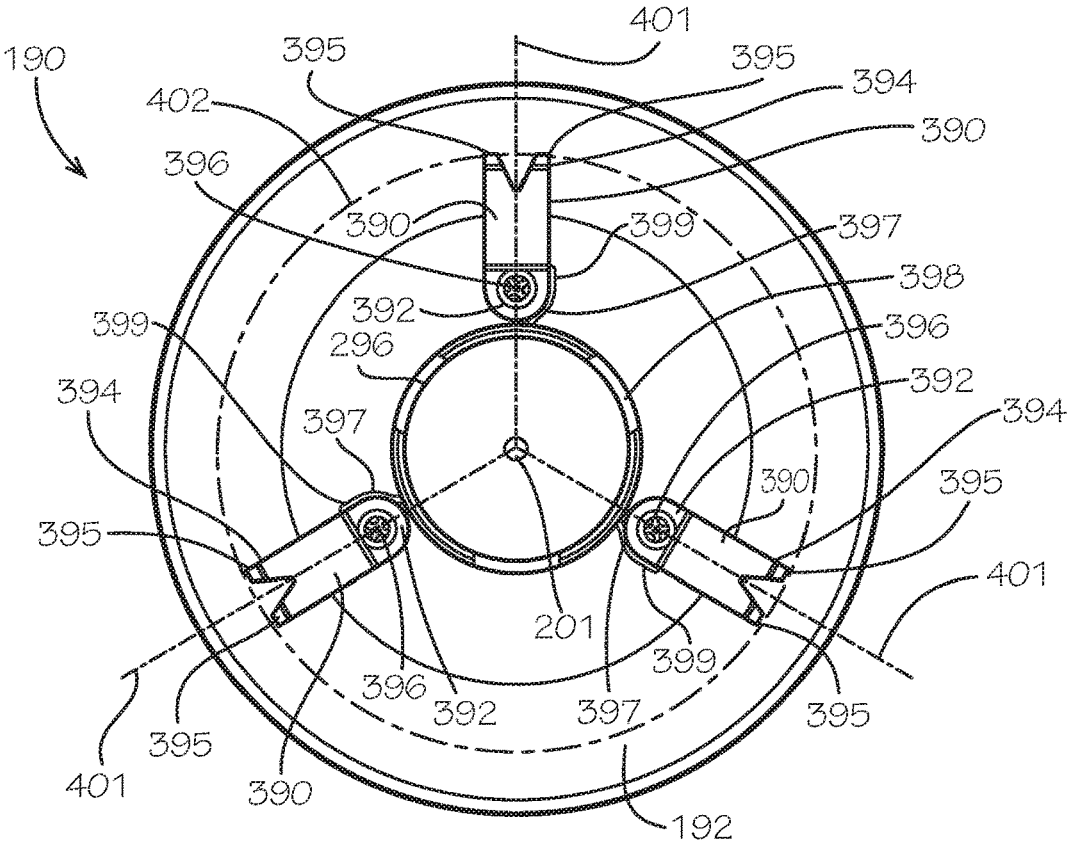
FIG. 4 is a top view of a trim piece of the can light assembly of FIG. 1 with retention clips of the trim piece in an engaged position.
Figure 5:
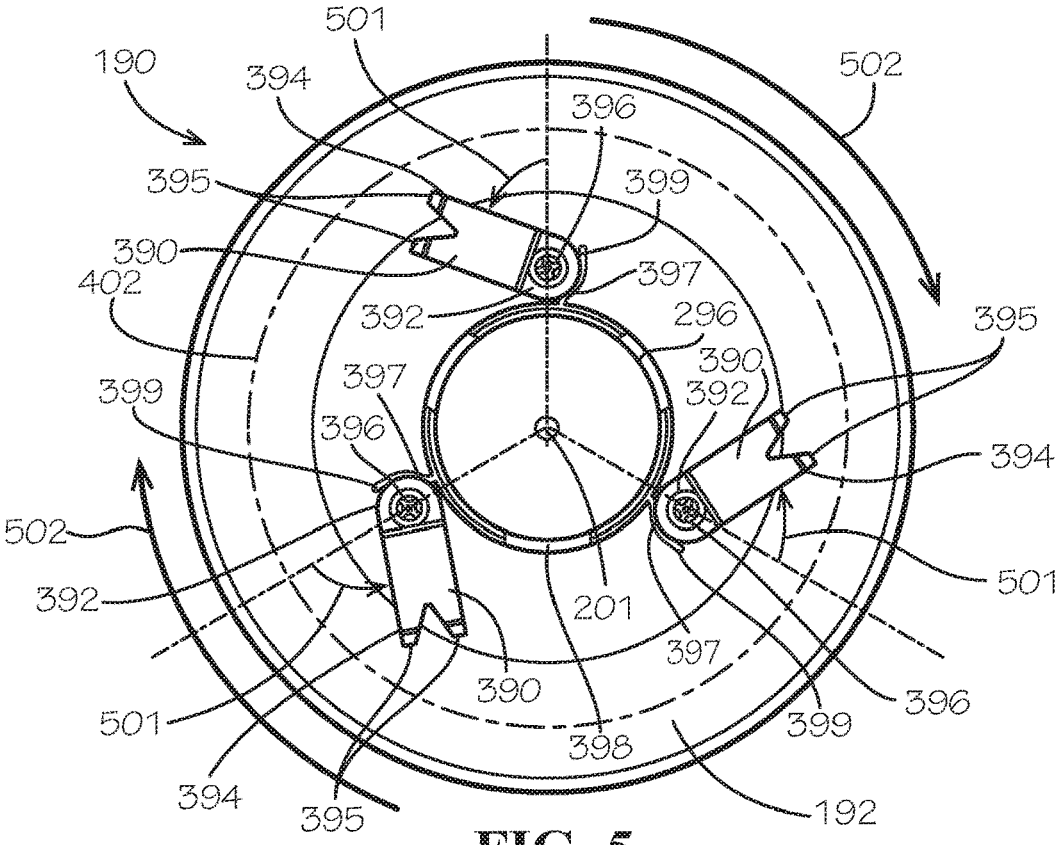
FIG. 5 is a top view of the trim piece of FIG. 4 with the retention clips in a disengaged position.

FIG. 4 is a top view of the trim piece 190 of the can light assembly 100 of FIG. 1 in the engaged position. FIG. 5 is a top view of the trim piece 190 of the can light assembly 100 of FIG. 1 in the disengaged position. As shown, each retention clip 390 can rotate around the respective fasteners 396 relative to the bases 397. Each retention clip 390 can rotate about and between the engaged position and the disengaged position. To place each retention clip 390 in the engaged position, the retention clips 390 can be rotated about the respective fasteners 396 until the retention clips 390 contact the walls 399 of the bases 397. The walls 399 can be parallel to a radial direction 401 of the axis 201, and contacting the retention clips 390 with the walls 399 can align the respective retention clips 390 with the radial direction 401 of the axis 201. The walls 399 can also prevent the retention clips 390 from being rotated past the engagement position. For example and without limitation, in the present aspect, the walls 399 can prevent rotation of the retention clips 390 in a clockwise direction past the radial direction 401. In other aspects, the walls 399 can be configured to limit rotation in a counter-clockwise direction.

The retention clips 390 can be rotated away from the walls 399 in a withdrawal rotational direction 501 to place the retention clips 390 in the disengaged position. In the disengaged position, the retention clips 390 can be angled inward with respect to the radial direction 401. In the present aspect, the retention clips 390 can be substantially tangentially oriented relative to the top trim aperture 296. The teeth 395 can be disposed radially inward compared to the engaged position.

A dashed circle 402 can represent a trim housing bore 660 defined by an inner trim housing surface 662 of the trim housing 160, as shown in FIG. 6. In the engaged position, the teeth 395 can engage and cut into the inner trim housing surface 662 as shown by contact between the dashed circle 402 and the teeth 395 in FIG. 4. Engagement between the teeth 395 and the inner trim housing surface 662 can axially secure the trim piece 190 to the trim housing 160 along the axis 201. In the disengaged position, the teeth 395 can be withdrawn from contact with the inner trim housing surface 662, as shown by the teeth 395 being positioned radially inward from the dashed circle 402 in FIG. 5.

In the present aspect, the retention clips 390 can be repositioned from the engaged position to the disengaged position by rotating the trim piece in a disengagement rotational direction 502 relative to the trim housing 160. When the trim piece 190 is rotated in the disengagement rotational direction 502, engagement between the teeth 395 and the inner trim housing surface 662 prevents the retention clips 390 from rotating together with the trim piece 190. Instead, the teeth 395 can act as a pivot point, and the retention clips 390 can rotate about the fasteners 396 relative to the respective bases 397 in the withdrawal rotational direction 501 until the teeth 395 break contact with the inner trim housing surface 662. As shown, the withdrawal rotational direction 501 can be opposite from the disengagement rotational direction 502. For example and without limitation, when viewed from the top trim piece end 398, the disengagement rotational direction 502 can be a clockwise rotational direction, and the withdrawal rotational direction 501 can be a counter-clockwise rotational direction in the present aspect. In other aspects, the disengagement rotational direction 502 can be a counter-clockwise rotational direction, and the withdrawal rotational direction 501 can be a clockwise rotational direction.

Figure 7:
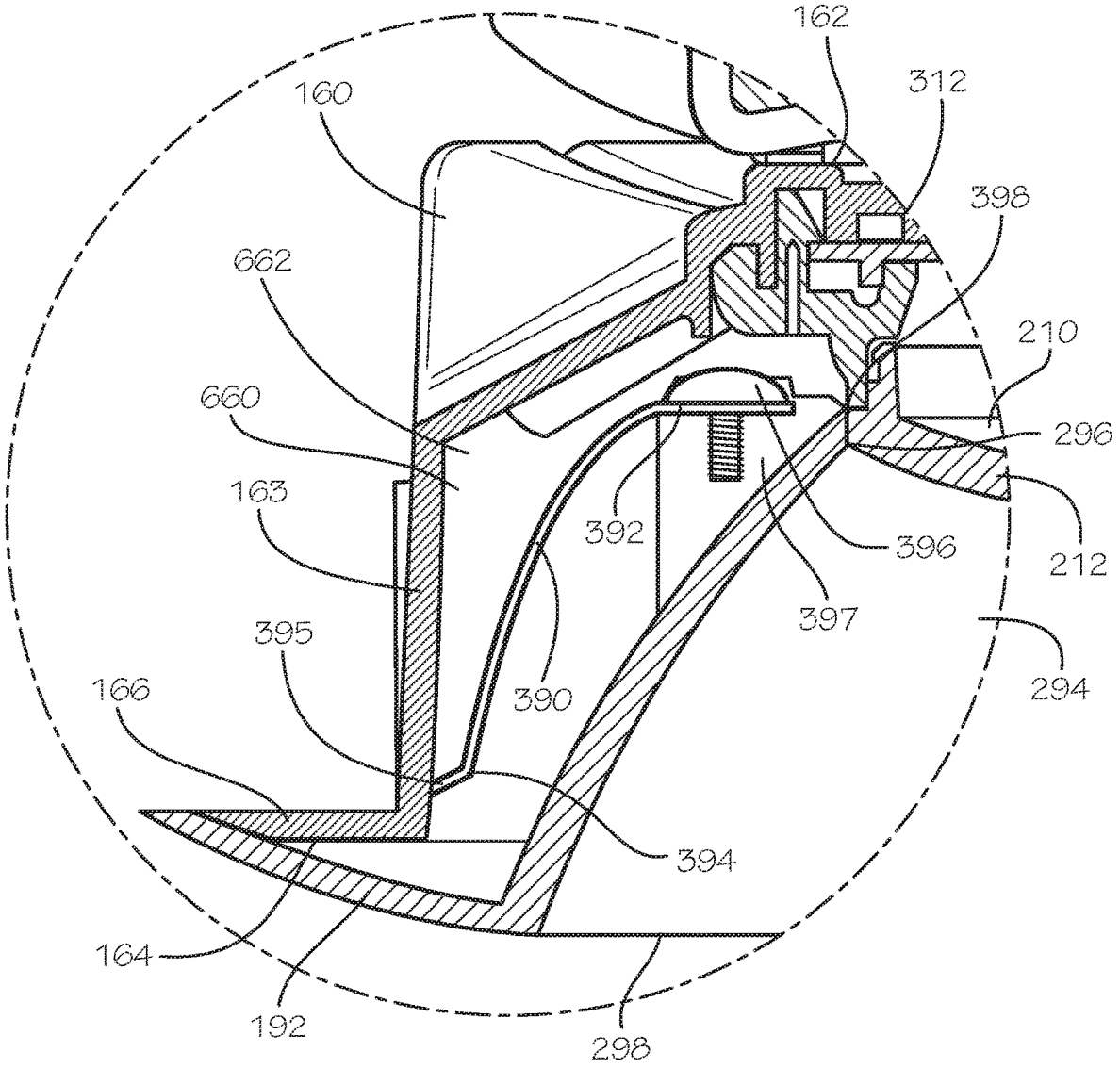
FIG. 7 is a detail cross-sectional view of the can light assembly of FIG. 1 taken from Detail 7 of FIG. 6.

FIG. 6 is a cross-sectional view of the can light assembly 100 of FIG. 1 in the closed position taken along line 6-6 shown in FIG. 1. FIG. 7 is a detail cross-sectional view of the can light assembly 100 of FIG. 1 taken from Detail 7 of FIG. 6. The trim housing bore 660 can be defined within the belled portion 163 of the trim housing 160 by the inner trim housing surface 662 of the trim housing 160 as shown in FIG. 6. The belled portion 163 can define a concave shape, and the trim housing bore 660 can extend into the trim housing 160 from the bottom trim housing end 164 and towards the top trim housing end 162. The trim housing bore 660 can define an axis 601, and the axis 601 can be coincident with the axis 201 of the trim piece bore 294 when the trim piece 190 is axially secured within the trim housing bore 660 relative to the axes 201,601.

The top trim piece end 398 can be received within the trim housing bore 660, and the trim piece rim 192 can engage the trim housing rim 166. With the trim piece 190 received within the trim housing bore 660, the teeth 395 of the retention clips 390 can engage the inner trim housing surface 662 to secure the trim piece 190 within the trim housing 160 as shown in FIG. 7. Interference between the teeth 395 and the inner trim housing surface 662 can elastically deflect the second ends 394 of the retention clips 390 radially inward with respect to the axes 201,601. The retention clips 390 can exert a residual force biasing the teeth 395 to engage the inner trim housing surface 662, thereby resisting withdrawal of the trim piece 190 from the trim housing bore 660 along the axes 201,601. Once deflected inwards, the teeth 395 can extend radially outward and axially downward from the second end 394 of the retention clip 390, and any force exerted on the trim piece 190 downward along the axes 201,601 can bias the teeth 395 to further cut into the inner trim housing surface 662 due to the orientation, thereby resisting the force.

In the present aspect, the trim piece 190 can be rotatable about the axes 201,601 relative to the trim housing 160 when the trim piece 190 is secured within the trim housing bore 660. In the present aspect, the teeth 395 can comprise a hardened material, such a metal, and the teeth 395 can be configured to cut or dig into the inner trim housing surface 662. In other aspects, the teeth 395 can comprise a softer material, such as a plastic, and the teeth 395 can be configured to engage circumferential grooves or ridges defined by the inner trim housing surface 662.

As shown in FIG. 6, the fastener 368 of the bull clip 168 can extend through a fastener channel 667 defined by a bull clip mounting base 668 of the belled portion 163 of the trim housing 160. As shown, the bull clip mounting base 668 can extend into the trim housing bore 660. When rotating the trim piece 190 relative to the trim housing 160 in order to disengage the trim piece 190 from the trim housing 160, the teeth 395 can sometimes slide relative to the inner trim housing surface 662 which can prevent the respective retention clip 390 from rotating about the fastener 396 from the engaged position to the disengaged position. If sliding occurs and the retention clips 390 do not rotate to the disengaged position due to friction of the teeth 395, further rotation of the trim piece 190 relative to the trim housing 160 can cause the retention clips 390 to contact the bull clip mounting base 668 within the trim housing bore 660. Interference between the bull clip mounting base 668 and the retention clips 390 can force the retention clips to rotate to the disengaged position, thereby allowing the trim piece 190 to be withdrawn from the trim housing bore 660.

A circuit box cavity 670 can be defined within the circuit box 170, and the circuit board 610 can be disposed within the circuit box cavity 670. The circuit board 610 can be connected to a light board 612 of the light engine 210 by the pin connectors 310,312. The light board 612 can comprise a plurality of light sources 614 which can be configured to emit visible light through the lens 212. The light sources 614 can be disposed within a light engine cavity 618 defined between the light board 612, the lens 212, and a light engine housing 616 of the light engine 210.

In the present aspects, the circuit board 610 and the light engine 210 can be printed circuit boards ("PCBs"), and the light sources 614 can be solid state light ("SSL") sources, such as light-emitting diodes ("LED"), organic light-emitting diodes ("OLED"), polymer light-emitting diodes ("PLED"), or other semiconductor sources of illumination. The circuit board 610 can comprise digital logic circuitry configured to convert the incoming AC power input to a direct current ("DC") power output supplied to the light sources 614 of the light board 612, as well as to control voltage, amperage, frequency, wave form shape, and/or the like of the DC power output.

Figure 8:
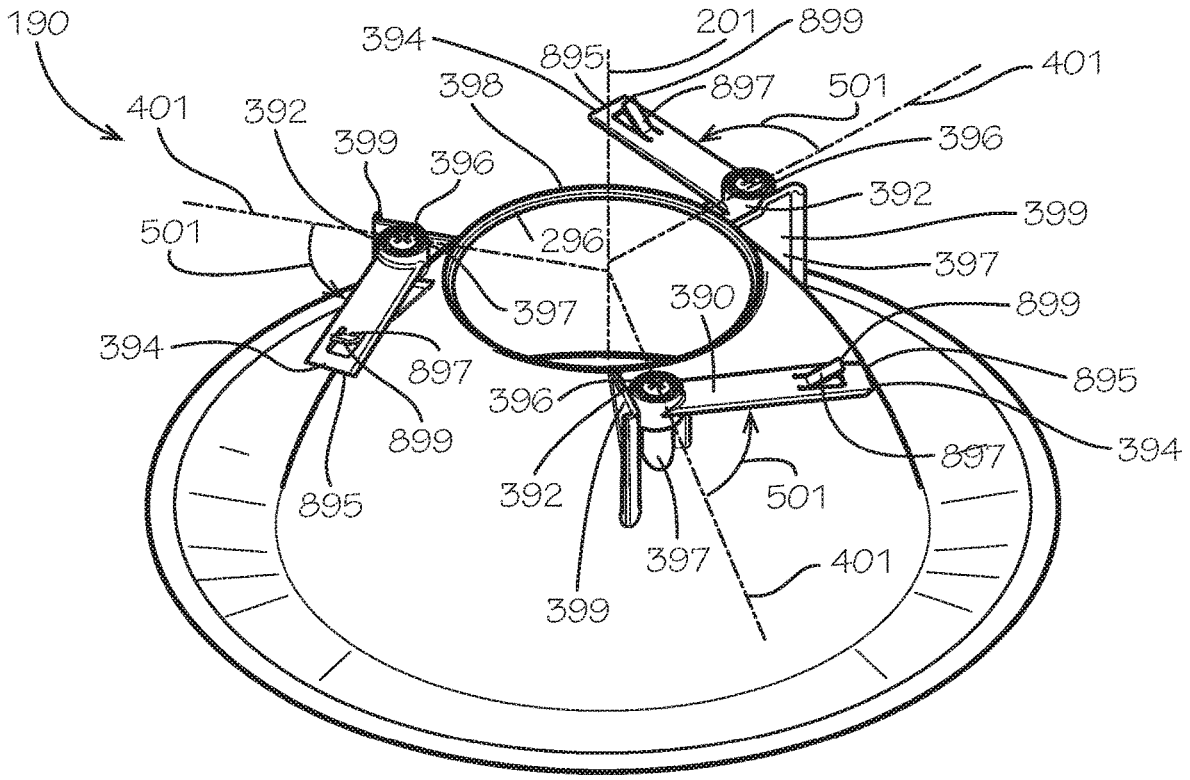
FIG. 8 is a perspective view of the trim piece comprising another aspect of the retention clips in the disengaged position in accordance with another aspect of the present disclosure.
Figure 9:
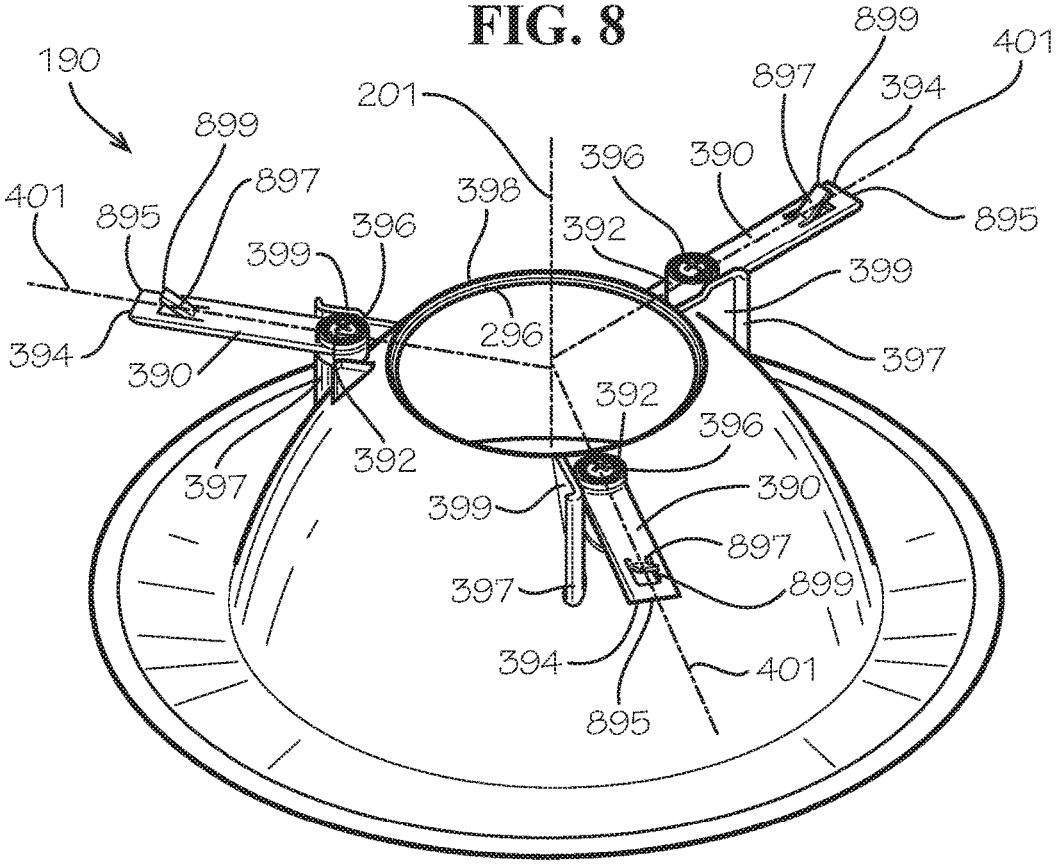
FIG. 9 is a perspective view of the trim piece of FIG. 8 with the retention clips in the engaged position.

FIGS. 8 and 9 show perspective views of the trim piece 190 of FIG. 1 comprising another aspect of the retention clips 390 in accordance with another aspect of the present disclosure. The retention clips 390 can be in the disengaged position in FIG. 8, and the retention clips 390 can be angled inward in the withdrawal rotational direction 501 relative to the radial direction 401 of the axis 201. The retention clips 390 can be in the engaged position and aligned with the radial direction 401 of the axis 201 in FIG. 9. In the present aspect, the retention clips 390 can extend outwards in the radial direction 401 relative to the axis 201 in the engaged position without extending axially upward or downward with respect to the axis 201. In other aspects, the retention clips 390 can also extend axially upward or downward with respect to the axis 201.

In place of the teeth 395 (teeth 395 shown in FIG. 3), the second end 394 can define a first beveled edge 895. Additionally, the retention clips 390 can each define a secondary retention tab 897 disposed proximate to the second end 394. Each secondary retention tab 897 can extend outwards from the respective retention clip 390 proximate to the second end 394, and each secondary retention tab 897 can define a second beveled edge 899. When the top trim piece end 398 is inserted into the trim housing bore 660 (trim housing bore 660 shown in FIG. 6), the second ends 394 can be deflected axially downward and radially inward relative to the axis 201, and both the beveled edges 895,899 of each retention clip 390 can engage the inner trim housing surface 662 (inner trim housing surface 662 shown in FIG. 6) to secure the trim piece 190 within the trim housing 160 (trim housing 160 shown in FIG. 1). In some aspects, the beveled edges 895,899 can be configured to engage a plurality of grooves or a plurality of ridges defined by the inner trim housing surface 662, similar to the plurality of grooves 1190 shown in FIGS. 11 and 12.

FIG. 10 is a perspective exploded view of another aspect of the can light assembly 100 in accordance with another aspect of the present disclosure. In the aspect shown, the can light assembly 100 can be sized for a 6" diameter nominal opening. The trim housing 160 can define protuberances 1060 which can extend outwards from the belled portion 163 of the trim housing 160 and down to the trim housing rim 166. The protuberances 1060 can correspond to pockets 1160 (pockets 1160 shown in FIG. 11) which can extend outwards from the trim housing bore 660 (trim housing bore 660 shown in FIG. 6), and the pockets 1160 can be configured to receive the retention clips 390 of the trim piece 190.

The can light assembly 100 of the present aspect can comprise another aspect of the trim piece 190 and retention clips 390 in accordance with another aspect of the present disclosure. In the present aspect, the trim piece 190 can comprise three retention clips 390 which can be equally circumferentially spaced around the trim piece 190. The retention clips 390 can define the first beveled edges 895, the secondary retention tabs 897, and the second beveled edges 899, and in the present aspect, the retention clips 390 can be attached and rotationally fixed to the bases 397. The bases 397 can be defined around the reflector portion 380 of the trim piece 190; however in other aspects, the bases 397 can be disposed at the top trim piece end 398 (top trim piece end 398 shown in FIG. 11). Each base 397 can define a base slot 1096 and the retention clips 390 can each define a locking tab 1196 (locking tabs 1196) shown in FIG. 11) at the first end 392. The locking tabs 1196 can be received and secured within the base slots 1096 of the respective based 397 to secure the each respective retention clip 390 to the respective base 397.

Figure 11:
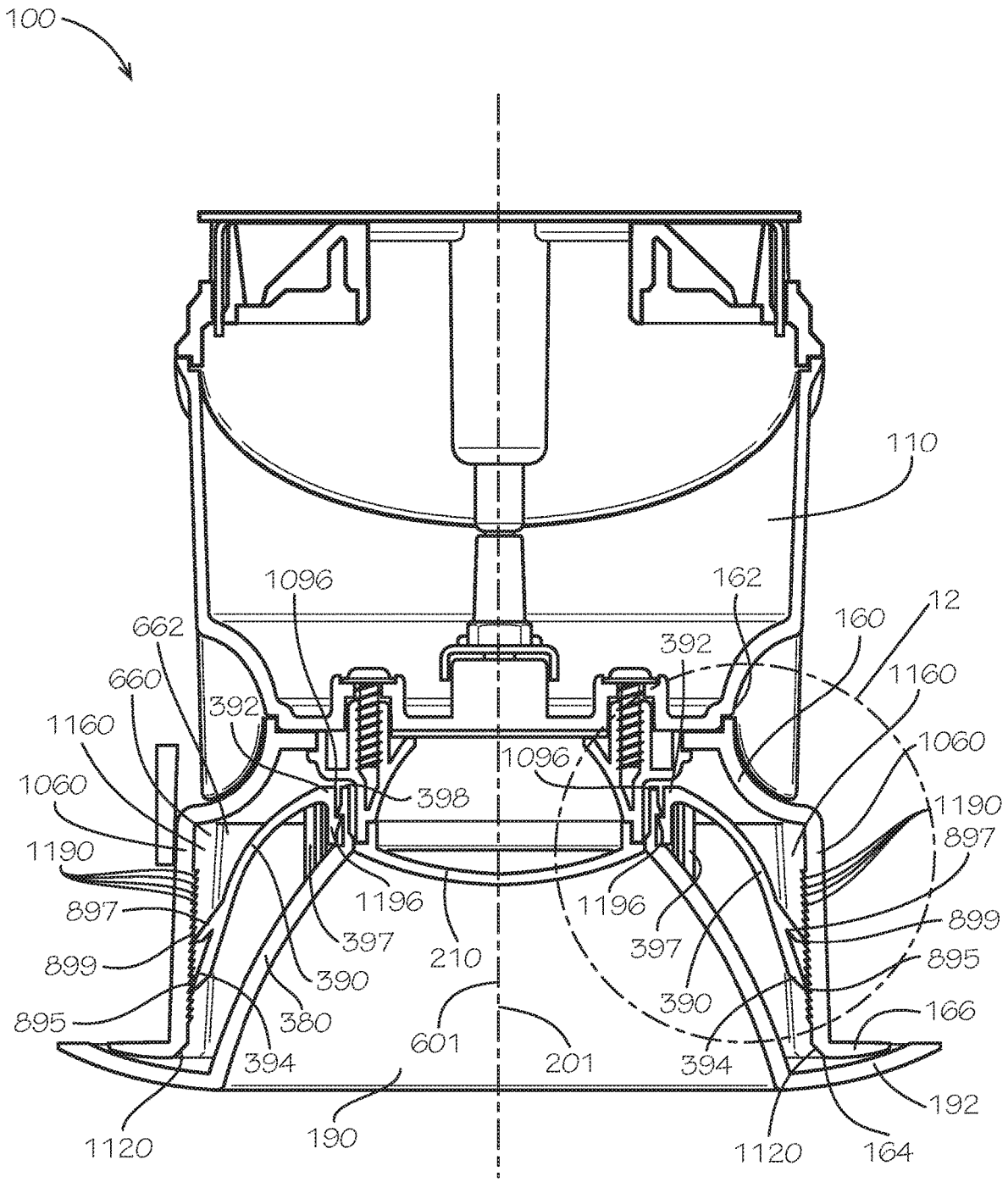
FIG. 11 is a cross-sectional view of the can light assembly of FIG. 10 comprising another aspect of the trim piece and the trim housing in accordance with another aspect of the present disclosure.
Figure 12:
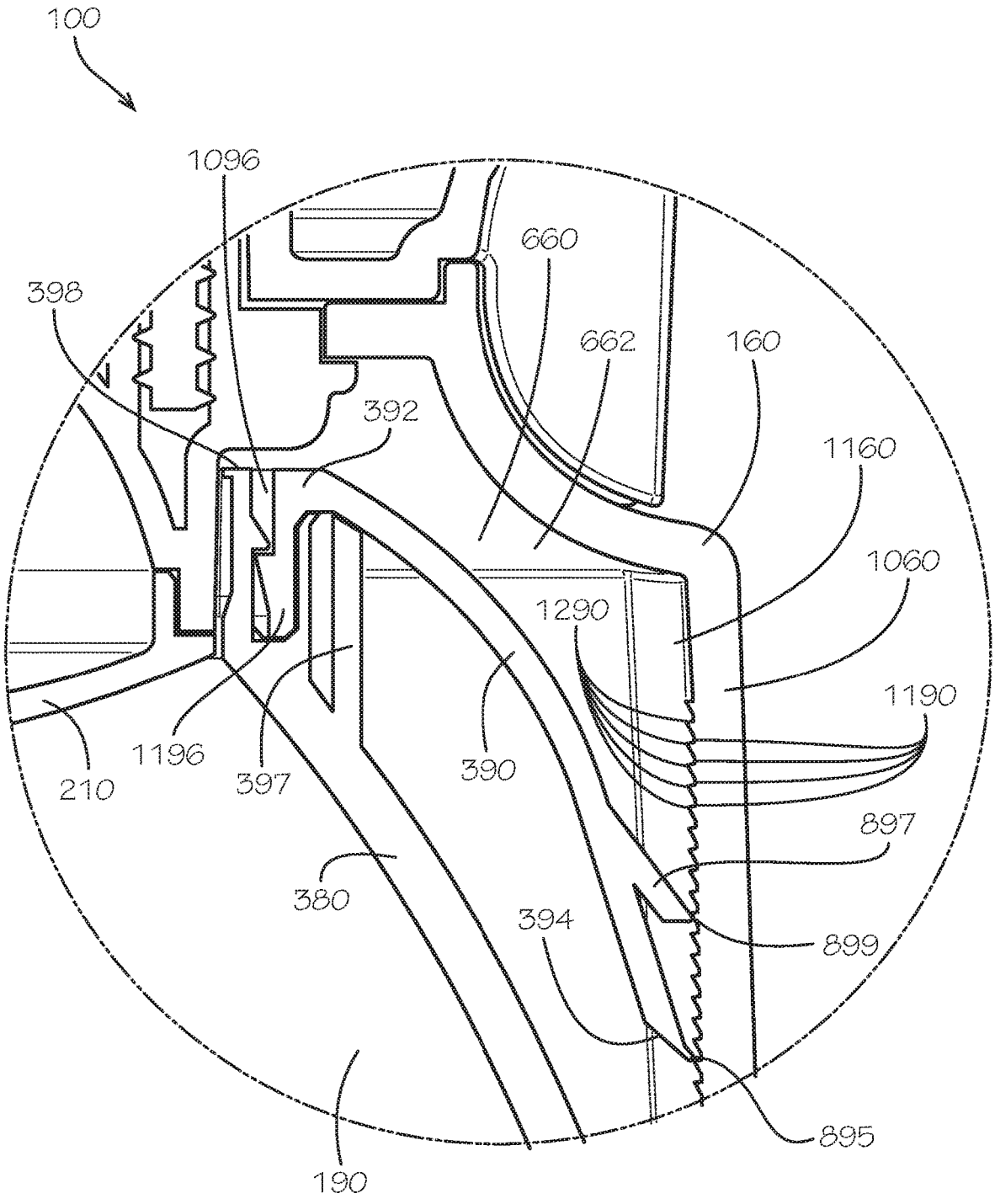
FIG. 12 is a detail cross-sectional view of the can light assembly of FIG. 11 taken from Detail 12 shown in FIG. 11.

FIG. 11 is a cross-sectional view of the can light assembly 100 of FIG. 10 comprising another aspect of the trim piece 190 and trim housing 160 in accordance with another aspect of the present disclosure. In the present aspect, the trim piece 190 can comprise two retention clips 390 of the aspect of FIG. 10 secured to two bases 397 positioned opposite from one another. FIG. 12 is a detail cross-sectional view of the can light assembly 100 of FIG. 11 taken from Detail 12 shown in FIG. 11. As shown, the inner trim housing surface 662 can define the pockets 1160 which can extend radially outwards from the trim housing bore 660 within the respective protuberances 1060. The pluralities of grooves 1190 can be defined by the inner trim housing surface 662 within each pocket 1160. As shown in FIG. 12, the plurality of grooves 1190 can be defined between adjacent ridges of a plurality of raised ridges 1290 defined by the inner trim housing surface 662. In other aspects, the grooves 1190 can be defined extending into the inner trim housing surface 662.

The second ends 394 of the retention clips 390 can be received by the pockets 1160 which can cause the second ends 394 to deflect radially inward and axially downward with respect to the axes 201,601. A pocket chamfer 1120 can be defined between the bottom trim housing end 164 and each of the pockets 1160. The angled pocket chamfer 1120 can guide the second ends 394 radially inward when the trim piece 190 is aligned and inserted into the trim housing bore 660. Deflection of the second ends 394 can engage the beveled edges 895,899 with the respective pluralities of grooves 1190, and the retention clips 390 can exert a residual radially outward force acting against the grooves 1190 to prevent the trim piece 190 from being withdrawn from the trim housing bore 660.

Figure 13:
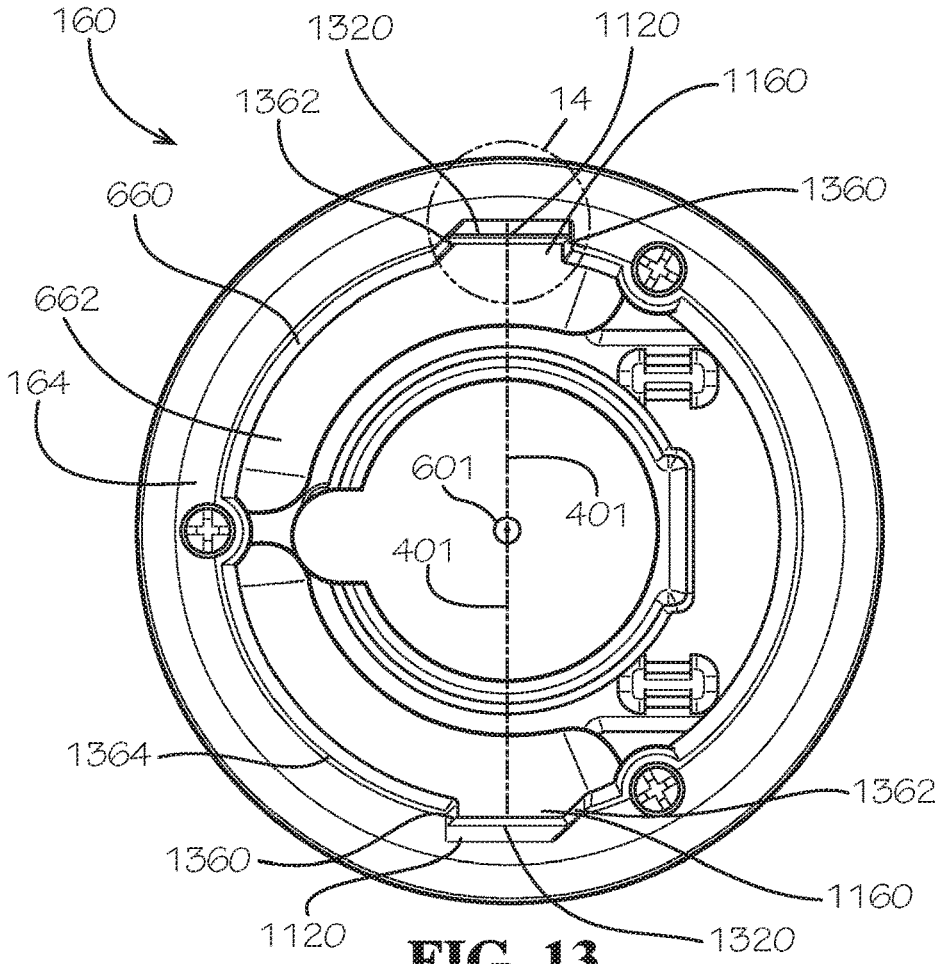
FIG. 13 is a bottom view of the trim housing of FIG. 11.
Figure 14:
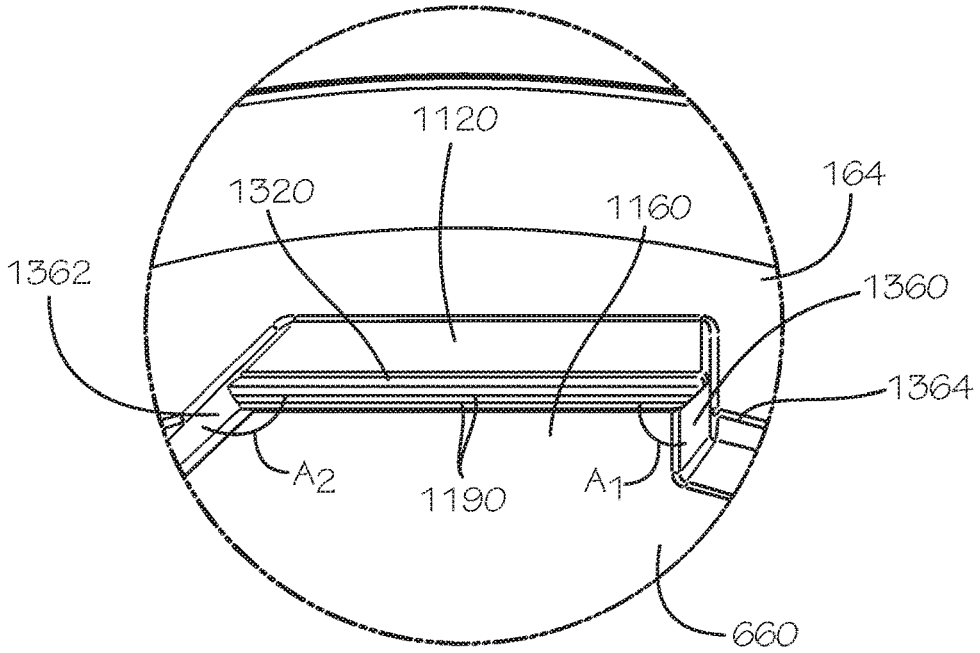
FIG. 14 is a detail view of a pocket of the trim housing of FIG. 11 taken from Detail 14 shown in FIG. 13.

FIG. 13 is a bottom view of the trim housing 160 of the can light assembly 100 of FIG. 11, and FIG. 14 is a detail view of a one of the pockets 1160 of the trim housing of FIG. 13 taken from Detail 14 shown in FIG. 13. The pockets 1160 can extend outwards from a bottom opening 1364 of the trim housing bore 660. In the present aspect, each pocket 1160 can define a first pocket sidewall surface 1360, a second pocket sidewall surface 1362, and a pocket back wall surface 1320. The pocket back wall surface 1320 can extend between the respective pocket sidewall surfaces 1360,1362, and the pocket back wall surfaces 1320 can be substantially perpendicular to the radial direction 401 of the axis 601. The inner trim housing surface 662 can define the plurality of grooves 1190 on the pocket back wall surfaces 1320, and the grooves 1190 can extend between the adjacent pocket sidewall surfaces 1360,1362, substantially perpendicular to the radial direction 401 of the axis 601.

An first angle $A_1$ can be defined between the first pocket sidewall surface 1360 and the pocket back wall surface 1320, and a second angle $A_2$ can be defined between the second pocket sidewall surface 1362 and the pocket back wall surface 1320, as shown in FIG. 14. In the present aspect, the first pocket sidewall surface 1360 can be a square pocket sidewall surface which can be substantially perpendicular to the adjacent pocket back wall surface 1320 and parallel to the radial direction 401 of the axis 601. The first angle $A_1$ can be substantially equal to 90-degrees. In the present aspect, the second pocket sidewall surface 1362 can be an angled pocket sidewall surface, and the second angle $A_2$ can define an obtuse angle, such as 135-degrees for example and without limitation. Values of the angles are not limiting and are provided for exemplary purposes. In other aspects, the angles $A_1$, $A_2$ can define values larger or smaller than provided.

When the retention clips 390 engage the grooves 1190 as shown in FIGS. 11 and 12, the trim piece 190 (shown in FIG. 11) cannot be withdrawn from the trim housing bore 660 of the trim housing 160. Rotating the trim piece 190 relative to the trim housing 160 can contact the second ends 394 of the retention clips 390 with the second pocket sidewall surfaces 1362. Because of the angled orientation of the second pocket sidewall surfaces 1362, further rotation of the second ends 394 towards the second pocket sidewall surfaces 1362 can deflect the second ends 394 radially inward with respect to the axis 601, thereby disengaging the beveled edges 895,899 (shown in FIG. 11) from the grooves 1190. In effect, the second pocket sidewall surface 1362*s* can act as ramps which can lift the beveled edges 895,899 out of the grooves 1190.

With the retention clips 390 disengaged from the grooves 1190, the trim piece 190 can be withdrawn from the trim housing bore 660 of the trim housing 160. In some aspects, both of the pocket sidewall surfaces 1360,1362 can be angled pocket sidewall surfaces, and the trim piece 190 can be rotated in either direction relative to the trim housing 160 to disengage the retention clips 390 and release the trim piece 190 from the trim housing 160. The trim piece 190 can be re-secured to the trim housing 160 by simply aligning the retention clips 390 with the pockets 1160 and stabbing the top trim piece end 398 into the trim housing bore 660 until the trim piece rim 192 (shown in FIG. 11) contacts the trim housing rim 166. Stabbing the top trim piece end 398 into the trim housing bore 660 can comprise axially translating the trim piece 190 along the axis 601 without rotating the trim piece 190 about the axis 601.

In some aspects, the grooves 1190 can be defined by the inner trim housing surface 662 within the trim housing bore 660 rather than within the pockets 1160. In such aspects, the grooves 1190 can be broken into circumferential arc-shaped portions with ungrooved portions of the inner trim housing surface 662 circumferentially spaced between grooved portions of the inner trim housing surface 662. In such aspects, the second ends 394 of the retention clips 390 can be aligned with the grooved portions to secure the trim piece 190 to the trim housing 160, and the second ends 394 of the retention clips 390 can be aligned with the ungrooved portions to release the trim piece 190 from the trim housing 160.

In some aspects, the trim housing 160 can comprise a metal, such as aluminum, steel, zinc alloy, or any other suitable metal, and the trim housing 160 can act as a heat sink to draw heat away from the light engine 210. In other aspects, the trim housing 160 can comprise a plastic material, such as polycarbonate, acrylonitrile butadiene styrene, or any other suitable plastic. In such aspects, the trim piece 190 or the junction box housing 130 can act as the heat sink, and the trim piece 190 or the junction box housing 130 can comprise a heat conductive material such as a metal to draw heat away from the light engine 210.

In aspects in which the trim housing 160 comprises a metal, aspects of the retention clips 390 defining the teeth 395 can be desirable because the teeth 395 can cut directly into the trim housing 160 without requiring grooves 1190 to engage. Because metal can be expensive to form and machine, omitting the grooves 1190 can save on manufacturing costs and manufacturing steps. However, aspects of the retention clips 390 defining the beveled edges 895,899 can be used with a metallic trim housing 160 which can define the grooves 1190. In aspects in which the trim housing 160 comprises a plastic, grooves 1190 or ridges 1290 can easily and cheaply be formed, and aspects of the retention clips 390 defining teeth 395, beveled edges 895, 899, or a combination thereof can be utilized. While the trim system 161 is shown with an aspect of a can light comprising solid-state light sources, the trim system 161 can also be compatible with can lights comprising different light sources, such as incandescent bulbs, miniature fluorescent lights, halogen lights, or any other suitable light source.

The trim piece 190 can be easily installed and removed from the trim housing 160 with one hand. For example, an installer working on a ladder can hold the ladder with one hand and use the other hand to install or remove the trim piece 190. The trim piece 190 is simply installed by stabbing the top trim piece end 398 into the trim housing bore 660 so that the retention clips 390 engage the inner trim housing surface 662. The trim piece 190 can be axially stabbed into the trim housing bore 660 without requiring a twisting or rotational motion as required by a threaded retention mechanism. The trim piece rim 192 can be positioned flush with the trim housing rim 166 each time without the need for adjustment because the trim housing rim 166 can act as a positive stop for the trim piece rim 192. This eliminates the need for adjusting the can light assembly 100 at height in order to eliminate gaps between the trim piece rim 192 and the ceiling.

It should be emphasized that the above-described embodiments are merely possible examples of implementations, merely set forth for a clear understanding of the principles of the present disclosure. Many variations and modifications may be made to the above-described embodiment(s) without departing substantially from the spirit and principles of the present disclosure. Further, the scope of the present disclosure is intended to cover any and all combinations and sub-combinations of all elements, features, and aspects discussed above. All such modifications and variations are intended to be included herein within the scope of the present disclosure, and all possible claims to individual aspects or combinations of elements or steps are intended to be supported by the present disclosure.

That which is claimed is:

1. A trim system comprising:

a trim housing defining a top trim housing end and a bottom trim housing end, the trim housing defining an inner trim housing surface, the inner trim housing surface defining a trim housing bore extending into the trim housing from the bottom trim housing end towards the top trim housing end, the trim housing bore defining an axis, the inner trim housing surface defining a plurality of grooves; and a trim piece defining a top trim piece end and a bottom trim piece end, the top trim piece end inserted into the trim housing bore, the trim piece comprising a retention clip defining a first end and a second end, the first end secured to a base of the trim piece, the second end engaging a groove of the plurality of grooves and axially securing the trim piece to the trim housing relative to the axis, wherein the first end of the retention clip is secured to the base by a fastener, and the retention clip is rotatable about the fastener relative to the base about and between an engaged position and a disengaged position, and the retention clip extends radially outward from the first end to the second end relative to the axis in the engaged position, and the retention clip is angled inward relative to a radial direction of the axis in the disengaged position.

2. The trim system of claim 1, wherein:

the second end of the retention clip defines a beveled edge; and the beveled edge engages the groove of the plurality of grooves.

3. The trim system of claim 1, wherein the retention clip is rotationally fixed relative to the base.

4. The trim system of claim 3, wherein:

the base defines a base slot;

the retention clip defines a locking tab disposed at the first end; and the locking tab is received and secured within the base slot.

5. The trim system of claim 3, wherein:

the inner trim housing surface defines a pocket extending radially outwards from the trim housing bore relative to the axis;

the plurality of grooves are defined within the pocket; and the pocket defines an angled pocket sidewall surface configured to disengage the second end from the plurality of grooves when the second end is engaged with the angled pocket sidewall surface.

6. The trim system of claim 1, wherein:

the retention clip defines a secondary retention tab;

the secondary retention tab extends outwards from the retention clip proximate to the second end; and the secondary retention tab engages another groove of the plurality of grooves.

* * * * *